US006632783B1

(12) United States Patent
Giblin et al.

(10) Patent No.: US 6,632,783 B1
(45) Date of Patent: Oct. 14, 2003

(54) LIQUID DETERGENT PACKAGE WITH TRANSPARENT/TRANSLUCENT BOTTLE LABELS WITH UV ABSORBERS

(75) Inventors: Edward John Giblin, Hopatcong, NJ (US); Myongsuk Bae-Lee, Montville, NJ (US); Barbara Helen Bory, Fort Lee, NJ (US); Feng-Lung Gordon Hsu, Tenafly, NJ (US); Daniel Joseph Kuzmenka, Wood-Ridge, NJ (US); Dennis Stephen Murphy, Wyckoff, NJ (US); Kristina Marie Neuser, Cliffside Park, NJ (US)

(73) Assignee: Unilever Home & Personal Care USA, a division of Conopco, Inc., Greenwich, CT (US)

( * ) Notice: Subject to any disclaimer, the term of this patent is extended or adjusted under 35 U.S.C. 154(b) by 0 days.

(21) Appl. No.: 09/568,061

(22) Filed: May 10, 2000

(51) Int. Cl.[7] ..... C11D 17/04; C11D 3/42; B65D 23/08; B65D 81/30

(52) U.S. Cl. ..... 510/406; 510/120; 510/130; 510/159; 510/220; 510/276; 510/394; 206/524.1

(58) Field of Search ..... 510/406, 439, 510/394, 120, 130, 159, 220, 276; 206/524.1

(56) References Cited

U.S. PATENT DOCUMENTS

| | | | | | |
|---|---|---|---|---|---|
| 3,402,843 | A | | 9/1968 | Campbell | 215/100 |
| 3,812,041 | A | * | 5/1974 | Inamorato et al. | 252/89 |
| 3,812,042 | A | | 5/1974 | Verdier | 510/406 |
| 3,912,100 | A | | 10/1975 | Graham | 215/12 |
| 3,954,675 | A | * | 5/1976 | Inamorato et al. | 252/543 |
| 4,018,612 | A | * | 4/1977 | Chyung | 106/39.7 |
| 4,144,024 | A | * | 3/1979 | Lala | 8/25 |
| 4,302,364 | A | * | 11/1981 | Gosset et al. | 252/545 |
| 4,368,147 | A | * | 1/1983 | Inamorato et al. | 252/545 |
| 4,734,304 | A | | 3/1988 | Tsubone et al. | 428/35 |
| 4,759,876 | A | * | 7/1988 | Crossin | 252/543 |
| 4,983,653 | A | * | 1/1991 | Fukuda et al. | 524/91 |
| 5,085,903 | A | | 2/1992 | Kapp et al. | 428/34.6 |
| 5,629,365 | A | * | 5/1997 | Razavi | 524/37 |
| 5,681,628 | A | * | 10/1997 | Niederst et al. | 428/35.7 |
| 5,783,307 | A | * | 7/1998 | Fagerburg et al. | 428/412 |
| 5,799,837 | A | * | 9/1998 | Firestone et al. | 222/215 |
| 5,948,458 | A | | 9/1999 | Swartz et al. | 426/321 |
| 6,051,541 | A | * | 4/2000 | Neuser et al. | 510/337 |
| 6,159,918 | A | * | 12/2000 | Bae-Lee et al. | 510/293 |
| 6,258,771 | B1 | * | 7/2001 | Hsu et al. | 510/418 |

FOREIGN PATENT DOCUMENTS

| | | | | |
|---|---|---|---|---|
| EP | 461 537 | | | 12/1991 |
| GB | 1303810 | | | 1/1973 |
| GB | 1372102 | | | 10/1974 |
| GB | 2131826 | A | * | 6/1984 |
| GB | 2172608 | A | * | 9/1986 |
| GB | 2228940 | | | 9/1990 |
| JP | 05230238 | A | * | 9/1993 |
| JP | 06345879 | | | 12/1994 |
| JP | 09058687 | | | 3/1997 |
| JP | 2000056689 | A2 | * | 2/2000 |
| WO | WO-9411485 | A1 | * | 5/1994 |
| WO | WO-9726315 | A1 | * | 7/1997 |

OTHER PUBLICATIONS

Packaging Innovation, Nov. 1997, *Labels,* pp. 3–12.

Tinuvin, P., Material Safety Data Sheet, pp. 1–12, Jul. 16, 1996.

*Happi*/Nov. 1999, French Consumers Demand Fragrance for Their Francs, pp. 73–74, 76, 78 Pack Expo, Oct. 20, 1999, p. 20.

Epson Hilmer Graphics Company Advertisement entitled Synthetic Labels, Packaging World 63, Nov. 1999, p. 64.

* cited by examiner

*Primary Examiner*—Lorna M. Douyon

(57) ABSTRACT

A package with a label, wherein the material of which the label, label adhesive and/or top coating is made comprises UV absorbers to protect the product's colorant dye and other organic compounds. The package may contain translucent or transparent consumer product, such as an aqueous heavy duty liquid having colorant dye. The package may itself be transparent or translucent.

12 Claims, No Drawings

LIQUID DETERGENT PACKAGE WITH TRANSPARENT/TRANSLUCENT BOTTLE LABELS WITH UV ABSORBERS

FIELD OF THE INVENTION

The present invention relates to labels particularly for transparent or translucent bottles containing aqueous, transparent or translucent heavy duty liquid laundry detergents, or other consumer products which may comprise colorants. The labels or label adhesives or overprint varnishes/coatings comprise UV absorbers and optionally F-dyes (fluorescent dyes) or a combination to protect the colorants and other components present in the composition from damage by harmful UV radiation, and/or to protect the bottle material itself from UV radiation.

BACKGROUND OF THE INVENTION

Liquid detergents have traditionally been sold in opaque bottles. However, use of clear bottles can be aesthetically appealing to consumers since they can see the color of the product, its consistency, and suspended particles if they are present. Unfortunately, the use of clear bottles can lead to destruction of colorant, fragrance and other ingredients in the product by UV light. Also, UV light can adversely affect components in the bottle material itself, such as PE, PP or PVC polymers. By UV light is meant light having a wavelength of about 250 to about 460 nanometers (nm). Specifically, UVA wavelengths are generally in the range 320–400 nm, UVB wavelengths range from about 290 to 320 nm and UVC wavelengths range below 290 nm, down to about 250 nm.

It has been known in the art that UV absorbers can be added to the bottle material during manufacture of clear bottles to protect them from becoming brittle and to protect the ingredients inside the bottle. For instance, in GB 2228940, the use of a dicarboxylate in polyester bottles to protect contents—mainly food—from radiation of 320–360 nm wavelength is described. The composition is formed into a packaging material, eg. a film, bottle or other like containers. In example 5, the polymers are molded into 1\0–10 mm thick transparent films.

In EP 461 537 the use of coatings for blocking UV radiation from passing through glass bottles is described. Beverages such as beer, cosmetics, medicines and food are mentioned. It is also mentioned that the light transmitting container may be plastic. '537 also mentions the treatment of the bottles with a delustering agent to reflect and diffuse harmful light at the surface.

WO 97/26315 discloses transparent containers with specific chromacity defined by x and y values. Blue or violet dyes are mentioned for the container and fluorescent blue or violet dyes are mentioned for the liquid.

GB 1,303,810 discloses clear liquid medium and visually defined particles suspended therein.

U.S. Pat. No. 3,812,042 to Verdier discloses a clear package containing liquids with a viscosity and clarity control system comprising urea, lower aliphatic alcohol and optional hydrotrope.

SUMMARY OF THE INVENTION

The present invention is directed to the use of UV absorbers and optionally F-dye in a label or the label's adhesive or overprint varnishes/coatings, or inner coextruded "adhesive" polymer layer on a container, particularly to reduce the destruction by UV light of colorant dye and/or other UV sensitive ingredients in a product held within the container or to protect the material of which the package is made or ingredients therein. In accordance with the present invention, the level of UV absorber additive in the label may be small (0.001 to about 3%, especially from 0.05 to 0.5 wt. %).

The present invention finds particular use in transparent or translucent labels especially for transparent or translucent containers. Preferably the container is a bottle. The invention is also of particular use where the transparent or translucent package contains a transparent or translucent liquid product although the product may also be opaque.

The contents of the container may comprise consumer products such as light duty liquid detergents (hand dishwashing detergents), heavy duty detergents, automatic dishwashing gels, personal washing compositions, such as body washes, shampoos, or fabric softeners. Particularly preferred are enzyme-containing transparent/translucent heavy duty liquid detergents. The UV absorber in the label is intended to protect against destruction of colorant dye in the product (e.g., caused by the light impacting dye molecules through the clear bottle) and secondarily to protect the packaging materials, such as PE, PP or PVC polymers from UV damage.

The label is preferably a transparent or translucent, in-mold or pressure—sensitive, plastic label. Preferably, the label is applied to a clear or translucent bottle. A product's colorant, perfume and other organic chemical components can degrade when exposed to UV light, which is strong enough to break chemical bonds. The use of a UV absorber and optionally an F-dye in the label or the label's adhesive or overprint varnishes/coatings would protect the product and preserve its appearance, odor and quality, and also would protect the plastic bottle or other type of plastic package from degradation.

For a more complete understanding of the above and other features and advantages of the invention, reference should be made to the following description of the preferred embodiments.

DETAILED DESCRIPTION OF THE INVENTION

Package Material and Label

The package of the invention is preferably a polymeric bottle, although other packages such as thermoforms or injection-molded components, polymeric cartons, paperboard cartons with film windows and glass bottles may be used.

Clear packaging materials with which this invention may be used include, but are not limited to: polypropylene (PP), polyethylene (PE), polycarbonate (PC), polyamides (PA) and/or polyethylene terephthalate (PETE), polyvinylchloride (PVC); and polystyrene (PS) or multilayer combinations.

The transparent container according to the invention preferably has a transmittance of more than 25%, more preferably more than 30%, more preferably more than 40%, more preferably more than 50% in the visible part of the spectrum (approx. 410–800 nm).

Alternatively, absorbency of the container may be measured as less than 0.6 or by having transmittance greater than 25%, wherein % transmittance equals:

$$\frac{1}{10^{absorbancy}} \times 100\%$$

For purposes of the invention, as long as one wavelength in the visible light range has greater than 25% transmittance, it is considered to be transparent/translucent.

Enzyme deactivation as a result of UV-damage may occur at very low transmission of UV-B radiation through the container wall.

The bottle or other container of the invention may be made by conventional techniques such as blow molding. UV absorber and optionally f-dye or a combination may optionally be additionally added to the polymeric material of which the bottle is made while it is molten and is then mixed therewith prior to forming the container or coated on the glass bottle surface. The additives may also be added to the hot melt adhesive on an in-mold label, or to the pressure-sensitive adhesive on the back of a pressure-sensitive label. Alternatively, the UV absorbers and/or F-dyes may be added to the overprint varnishes or top coatings.

A suitable container is disclosed in Brown et al. U.S. patent application Ser. No. 08/777,641, now abandoned which is hereby incorporated by reference.

The bottle wall may comprise one or more layers, one or more of which may include F-dyes and/or UV absorbers. The layers may if desired be very thin, eg., less than 0.01 inch thick and may range to and above 0.2 inch in thickness, especially from 0.015 inches to 0.02 inches on the low end, up to 0.17 or 0.2 inch on the high end.

The container of the present invention may be of any form or size suitable for storing and packaging liquids for household use. For example, the container may have any size but usually the container will have a maximal capacity of 0.05 to 15 L, preferably, 0.1 to 5 L, more preferably from 0.2 to 2.5 L. Preferably, the container is suitable for easy handling. For example, the container may have handle or a part with such dimensions to allow easy lifting or carrying the container with one hand. The container preferably has a means suitable for pouring the liquid detergent composition and means for reclosing the container. The pouring means may be of any size or form but, preferably will be wide enough for convenient dosing of the liquid detergent composition. The closure may be of any form or size but usually will be screwed or snapped on the container to close the container. The closure may be a cap which can be detached from the container. Alternatively, the cap can still be attached to the container, whether the container is open or closed. The closing means may also be incorporated in the container.

In accordance with the invention, UV absorbers and/or F-dyes are incorporated into labels or label adhesives or overprint coatings to be affixed to the packaging material, eg. clear labels. The labels may be made of any suitable polymeric material, eg., polypropylene, polyethylene (HDPE, MDPE, LDPE, LLDPE), polypropylene (PP, OPP), blends of PP and PE, polyvinyl. chloride (PVC), polyethylene terephthalate (EPET, PETG, OPET) and polystyrene (PS, HIPS). A UV absorber, a blend of UV absorbers, a fluorescent dye, a blend of F-dyes, or a blend of a UV absorber and an F-dye may be added to clear plastic labels (in-mold, or top coatings on the label adhesives used for PS and IML's, pressure-sensitive or stretch or shrink-on label types) to add protection from UV light exposure for the product an/or the preferably plastic) package. Additive levels can range from 0.001 wt. % to 0.3 wt. %, preferably from 0.1% to 0.3% wt. Incorporation into the label's adhesive facilitates the manufacturing process, as the plastic film material would remain the same as non-UV protected label stock. This also would be true for overprint coatings.

The label may cover from e.g., 50% to 95% of the transparent or translucent surface of the container, particularly if it is a wrap-around type label. Preferably the label covers 50% to 95% of the total surface of the container, irrespective of whether all or part of the surface is transparent or translucent. For maximum protection, the UV-shielded label may also be applied to a plastic bottle which also contains a UV absorber or an F-dye or a blend of each or both types. Likewise, the product may contain F-dyes and/or UV absorbers, if desired. Label thickness for an IML (in mold label) usually ranges from 2 to 4 mils (0.002" to 0.004"), but could be thinner for stretch and shrink-on labels. At least a portion of the label covering the container will include indicia such as product information. The label would not be coated onto the container.

The UV absorbers and F-dyes which may be included in the labels and the packaging materials, including the closure, are those which are described below in connection with the laundry compositions.

LAUNDRY COMPOSITIONS

Fluorescent Dyes (F-dyes)

Classes of fluorescent dyes which may be used include stilbenes; coumarin and carbostyril compounds; 1,3-diphenyl-2-pyrazolines; naphthalimides; benzazdyl substitution products of ethylene, phenylethylene, stilbene, thiophene; and combined hateroaromatics.

Among fluorescent dyes which may be used are also the sulfonic acid salts of diamino stilbene derivatives such as taught in U.S. Pat. No. 2,784,220 to Spiegler or U.S. Pat. No. 2,612,510 to Wilson et al., both of which are hereby incorporated by reference. Polymeric fluorescent whitening agents as taught in U.S. Pat. No. 5,082,578, hereby incorporated by reference into the subject application, are also contemplated by this invention.

Optiblanc MTB and Optiblank NW (Stilbene triazine derivatives) are among the trade names oF dyes which may be used. These are available from 3V Sigma, S.p.A. of Bergamo, Italy.

Finally, other fluorescent dyes which may be used are defined in McCutcheon's Volume 2, Functional Materials, North American Edition as noted above in connection with UV absorbers.

If so desired, different F-dyes could be blended together in the packaging material or label of the invention.

Fluorescent dyes particularly useful for this application include, but are not limited to: the distyrylbiphenyl types such as Tinopal CBS-X from Ciba Geigy Corp. and the cyanuric chloride/diaminostilbene types such as Tinopal AMS, DMS, 5BM, and UNPA from Ciba Geigy Corp. and Blankophor DML from Mobay. Fluorescent dye may be present in the container with or without UV absorbers. Preferably, UV absorbers are excluded or essentially excluded from both the container and the formulation. F-dye may be present in the formulation contained in the container, but may be excluded or essentially excluded. If present, f-dye is used in the formulation, containers or label each optionally at from about 0.001% to about 3%, preferably between 0.001% and 0.5%, e.g., 0.1%, 0.2%, 0.3%, etc.

Colorant Dyes

Any type of colorant dye which may be destroyed by UV light may be used in the products used within the containers of the invention. Non-limiting examples of such include, but are not limited to the following: Hidacid blue from Hilton Davis; Acid blue 145 from Crompton Knowles and Tri-Con; Pigment Green No. 7, FD&C Green No. 7, Acid Blue 80, Acid Violet 48, and Acid Yellow 17 from Sandoz Corp.; D&C Yellow No. 10 from Warner Jenkinson Corp.

The dyes are present in the formulations at an amount of from 0.001% to 1%, preferably 0.01 to 0.4% of the composition. If desired, the dyes may also be present in the container at from 0.001% to 1%. Dyes which are not destroyed by UV light may also be used if desired.

Detergent Active

The compositions contained within the packages of the invention may include one or more surface active agents (surfactants) selected from the group consisting of anionic, nonionic, cationic, ampholytic and zwitterionic surfactants or mixtures thereof. The preferred surfactant detergents for use in the present invention are mixtures of anionic and nonionic surfactants although it is to be understood that any surfactant may be used alone or in combination with any other surfactant or surfactants. Generally, the surfactant will comprise at least 10% by wt. of the composition, e.g., 11% to 75%, preferably at least 15% to 70% of the total composition, more preferably 16% to 65%, even more preferably 20% to 65%.

Nonionic Surfactant

Nonionic synthetic organic detergents which can be used with the invention, alone or in combination with other surfactants, are described below.

As is well known, the nonionic detergents are characterized by the presence of an organic hydrophobic group and an organic hydrophilic group and are typically produced by the condensation of an organic aliphatic or alkyl aromatic hydrophobic compound with ethylene oxide (hydrophilic in nature). Typical suitable nonionic surfactants are those disclosed in U.S. Pat. Nos. 4,316,812 and 3,630,929.

Usually, the nonionic detergents are polyalkoxylated lipophiles wherein the desired hydrophile-lipophile balance is obtained from addition of a hydrophilic poly-lower alkoxy group to a lipophilic moiety. A preferred class of nonionic detergent is the alkoxylated alkanols wherein the alkanol is of 9 to 18 carbon atoms and wherein the number of moles of alkylene oxide (of 2 or 3 carbon atoms) is from 3 to 12. Of such materials it is preferred to employ those wherein the alkanol is a fatty alcohol of 9 to 11 or 12 to 15 carbon atoms and which contain from 5 to 8 or 5 to 9 alkoxy groups per mole.

Exemplary of such compounds are those wherein the alkanol is of 12 to 15 carbon atoms and which contain about 7 ethylene oxide groups per mole, e.g. Neodol 25-7 and Neodol 23-6.5, which products are made by Shell Chemical Company, Inc. The former is a condensation product of a mixture of higher fatty alcohols averaging about 12 to 15 carbon atoms, with about 7 moles of ethylene oxide and the latter is a corresponding mixture wherein the carbon atoms content of the higher fatty alcohol is 12 to 13 and the number of ethylene oxide groups present averages about 6.5. The higher alcohols are primary alkanols.

Other useful nonionics are represented by the commercially well-known class of nonionics sold under the trademark Plurafac. The Plurafacs are the reaction products of a higher linear alcohol and a mixture of ethylene and propylene oxides, containing a mixed chain of ethylene oxide and propylene oxide, terminated by a hydroxyl group. Examples include $C_{13}$–$C_{15}$ fatty alcohol condensed with 6 moles ethylene oxide and 3 moles propylene oxide, $C_{13}$–$C_{15}$ fatty alcohol condensed with 7 moles propylene oxide and 4 moles ethylene oxide, $C_{13}$–$C_{15}$ fatty alcohol condensed with 5 moles propylene oxide and 10 moles ethylene oxide, or mixtures of any of the above.

Another group of liquid nonionics are commercially available from Shell Chemical Company, Inc. under the Dobanol trademark: Dobanol 91-5 is an ethoxylated $C_9$–$C_{11}$ fatty alcohol with an average of 5 moles ethylene oxide and Dobanol 23-7 is an ethoxylated $C_{12}$–$C_{15}$ fatty alcohol with an average of 7 moles ethylene oxide per mole of fatty alcohol.

In the compositions of this invention, preferred nonionic surfadants include the $C_{12}$–$C_{15}$ primary fatty alcohols with relatively narrow contents of ethylene oxide in the range of from about 7 to 9 moles, and the $C_9$ to $C_{11}$ fatty alcohols ethoxylated with about 5–6 moles ethylene oxide.

Another class of nonionic surfactants which can be used in accordance with this invention are glycoside surfactants. Glycoside surfactants suitable for use in accordance with the present invention include those of the formula:

$$RO—R'O—_y(Z)_x$$

wherein R is a monovalent organic radical containing from about 6 to about 30 (preferably from about 8 to about 18) carbon atoms; R' is a divalent hydrocarbon radical containing from about 2 to 4 carbons atoms; 0 is an oxygen atom; y is a number which can have an average value of from 0 to about 12 but which is most preferably zero; Z is a moiety derived from a reducing saccharide containing 5 or 6 carbon atoms; and x is a number having an average value of from 1 to about 10 (preferably from about 1.5 to about 10).

A particularly preferred group of glycoside surfactants for use in the practice of this invention includes those of the formula above in which R is a monovalent organic radical (linear or branched) containing from about 6 to about 18 (especially from about 8 to about 18) carbon atoms; y is zero; z is glucose or a moiety derived therefrom; x is a number having an average value of from 1 to about 4 (preferably from about 1 to 4).

Nonionic surfactants particularly useful for this application include, but are not limited to: alcohol ethoxylates (e.g. Neodol 25-9 from Shell Chemical Co.), alkyl phenol ethoxylates (e.g. Tergitol NP-9 from Union Carbide Corp.), alkylpolyglucosides (e.g. Glucapon 600CS from Henkel Corp.), polyoxyethylenated polyoxypropylene glycols (e.g. Pluronic L-65 from BASF Corp.), sorbitol esters (e.g. Emsorb 2515 from Henkel Corp.), polyoxyethylenated sorbitol esters (e.g. Emsorb 6900 from Henkel Corp.), alkanolamides (e.g. Alkamide DC212/SE from Rhone-Poulenc Co.), and N-alkypyrrolidones (e.g. Surfadone LP-100 from ISP Technologies Inc.).

Nonionic surfactant is used in the formulation from about 0% to about 70%, preferably between 5% and 50%, more preferably 10–40% by weight.

Mixtures of two or more of the nonionic surfactants can be used.

Anionic Surfactant Detergents

Anionic surface active agents which may be used in the present invention are those surface active compounds which contain a long chain hydrocarbon hydrophobic group in their molecular structure and a hydrophilic group, i.e.; water solubilizing group such as sulfonate or sulfate group. The anionic surface active agents include the alkali metal (e.g. sodium and potassium) water soluble higher alkyl benzene sulfonates, alkyl sulfonates, alkyl sulfates and the alkyl polyether sulfates. They may also include fatty acid or fatty acid soaps. The preferred anionic surface active agents are the alkali metal, ammonium or alkanolamide salts of higher alkyl benzene sulfonates and alkali metal, ammonium or alkanolamide salts of higher alkyl sulfonates. Preferred higher alkyl sulfonates are those in which the alkyl groups contain 8 to 26 carbon atoms, preferably 12 to 22 carbon atoms and more preferably 14 to 18 carbon atoms. The alkyl group in the alkyl benzene sulfonate preferably contains 8 to 16 carbon atoms and more preferably 10 to 15 carbon atoms. A particularly preferred alkyl benzene sulfonate is the sodium or potassium dodecyl benzene sulfonate, e.g. sodium linear dodecyl benzene sulfonate. The primary and secondary alkyl sulfonates can be made by reacting long chain alpha-olefins with sulfites or bisulfites, e.g. sodium bisulfite. The alkyl sulfonates can also be made by reacting long chain normal paraffin hydrocarbons with sulfur dioxide and oxygen as described in U.S. Pat. Nos. 2,503,280, 2,507,088, 3,372,188 and 3,260,741 to obtain normal or secondary higher alkyl sulfonates suitable for use as surfactant detergents.

The alkyl substituent is preferably linear, i.e. normal alkyl, however, branched chain alkyl sulfonates can be employed, although they are not as good with respect to biodegradability. The alkane, i.e. alkyl, substituent may be terminally sulfonated or may be joined, for example, to the carbon atom of the chain, i.e. may be a secondary sulfonate. It is understood in the art that the substituent may be joined to any carbon on the alkyl chain. The higher alkyl sulfonates can be used as the alkali metal salts, such as sodium and potassium. The preferred salts are the sodium salts. The preferred alkyl sulfonates are the C10 to C18 primary normal alkyl sodium and potassium sulfonates, with the C10 to C15 primary normal alkyl sulfonate salt being more preferred.

Mixtures of higher alkyl benzene sulfonates and higher alkyl sulfonates can be used as well as mixtures of higher alkyl benzene sulfonates and higher alkyl polyether sulfates.

The alkali metal alkyl benzene sulfonate can be used in an amount of 0 to 70%, preferably 10 to 50% and more preferably 10 to 20% by weight.

The alkali metal sulfonate can be used in admixture with the alkylbenzene sulfonate in an amount of 0 to 70%, preferably 10 to 50% by weight.

Also normal alkyl and branched chain alkyl sulfates (e.g., primary alkyl sulfates) may be used as the anionic component).

The higher alkyl polyether sulfates used in accordance with the present invention can be normal or branched chain alkyl and contain lower alkoxy groups which can contain two or three carbon atoms. The normal higher alkyl polyether sulfates are preferred in that they have a higher degree of biodegradability than the branched chain alkyl and the lower poly alkoxy groups are preferably ethoxy groups.

The preferred higher alkyl poly ethoxy sulfates used in accordance with the present invention are represented by the formula:

$$R'—O(CH_2CH_2O)_p—SO_3M,$$

where R' is $C_8$ to $C_{20}$ alkyl, preferably $C_{10}$ to $C_{18}$ and more preferably $C_{12}$ to $C_{15}$; P is 2 to 8, preferably 2 to 6, and more preferably 2 to 4; and M is an alkali metal, such as sodium and potassium, or an ammonium cation. The sodium and potassium salts are preferred.

A preferred higher alkyl poly ethoxylated sulfate is the sodium salt of a triethoxy $C_{12}$ to $C_{15}$ alcohol sulfate having the formula:

$$C_{12\text{-}15}—O—(CH_2CH_2O)_3—SO_3Na$$

Examples of suitable alkyl ethoxy sulfates that can be used in accordance with the present invention are $C_{12\text{-}15}$ normal or primary alkyl triethoxy sulfate, sodium salt; n-decyl diethoxy sulfate, sodium salt; $C_{12}$ primary alkyl diethoxy sulfate, ammonium salt; $C_{12}$ primary alkyl triethoxy sulfate, sodium salt: $C_{15}$ primary alkyl tetraethoxy sulfate, sodium salt, mixed $C_{14\text{-}15}$ normal primary alkyl mixed tri- and tetraethoxy sulfate, sodium salt; stearyl pentaethoxy sulfate, sodium salt; and mixed $C_{10\text{-}18}$ normal primary alkyl triethoxy sulfate, potassium salt.

The normal alkyl ethoxy sulfates are readily biodegradable and are preferred. The alkyl poly-lower alkoxy sulfates can be used in mixtures with each other and/or in mixtures with the above discussed higher alkyl benzene, alkyl sulfonates, or alkyl sulfates.

The alkali metal higher alkyl poly ethoxy sulfate can be used with the alkylbenzene sulfonate and/or with an alkyl sulfonate or sulfonate, in an amount of 0 to 70%, preferably 10 to 50% and more preferably 10 to 20% by weight of entire composition.

Anionic surfactants particularly useful for this application include, but are not limited to: linear alkyl benzene sulfonates (e.g. Vista C-500 from Vista Chemical Co.), alkyl sulfates (e.g. Polystep B-5 from Stepan Co.), polyoxyethylenated alkyl sulfates (e.g. Standapol ES-3 from Stepan Co.), alpha olefin sulfonates (e.g. Witconate AOS from Witco Corp.), alpha sulfo methyl esters (e.g. Alpha-Step MC-48 from Stepan Co.) and isethionates (e.g. Jordapon CI from PPG Industries Inc.).

Anionic surfactant is used in the formulation from about 0% to about 60%, preferably between 5% and 40%, more preferably 8 to 25% by weight.

Cationic Surfactants

Many cationic surfactants are known in the art, and almost any cationic surfactant having at least one long chain alkyl group of about 10 to 24 carbon atoms is suitable in the present invention. Such compounds are described in "Cationic Surfactants," Jungermann, 1970, incorporated by reference.

Specific cationic surfactants which can be used as surfactants in the subject invention are described in detail in U.S. Pat. No. 4,497,718, hereby incorporated by reference.

As with the nonionic and anionic surfactants, the compositions of the invention may use cationic surfactants alone or in combination with any of the other surfactants known in the art. Of course, the compositions may contain no cationic surfactants at all.

Amphoteric Surfactants

Ampholytic synthetic detergents can be broadly described as derivatives of aliphatic or aliphatic derivatives of heterocyclic secondary and tertiary amines in which the aliphatic radical may be a straight chain or a branched and wherein one of the aliphatic substituents contains from about 8 to 18 carbon atoms and at least one contains an anionic water-solubilizing group, e.g. carboxy, sulfonate, sulfate.

Examples of compounds falling within this definition are sodium 3(dodecylamino)propionate, sodium 3-(dodecylamino)propane-1-sulfonate, sodium 2-(dodecylamino)ethyl sulfate, sodium 2-(dimethylamino) octadecanoate, disodium 3-(N-carboxymethyldodecylamino)propane 1-sulfonate, disodium octadecyl-imminodiacetate, sodium 1-carboxymethyl-2-undecylimidazole, and sodium N,N-bis(2-hydroxyethyl)-2-sulfato-3-dodecoxypropylamine. Sodium 3-(dodecylamino)propane-1-sulfonate is preferred.

Zwitterionic surfactants can be broadly described as derivatives of secondary and tertiary amines, derivatives of heterocyclic secondary and tertiary amines, or derivatives of quaternary ammonium, quaternary phosphonium or tertiary sulfonium compounds. The cationic atom in the quaternary compound can be part of a heterocyclic ring. In all of these compounds there is at least one aliphatic group, straight chain or branched, containing from about 3 to 18 carbon atoms and at least one aliphatic substituent containing an anionic water solubilizing group, e.g., carboxy, sulfonate, sulfate, phosphate, or phosphonate.

Specific examples of zwitterionic surfactants which may be used are set forth in U.S. Pat. No. 4,062,647, hereby incorporated by reference.

The amount of amphoteric used may vary from 0 to 50% by weight, preferably 1 to 30% by weight.

It should be noted that the compositions of the invention are preferably isotropic (by which is generally understood to be a homogenous phase when viewed macroscopically) and either transparent or translucent.

Total surfactant used is preferably at least 10%, preferably at least 15%, more preferably at least 20% by wt.

Builders/Electrolyte

Builders which can be used according to this invention include conventional alkaline detergency builders, inorganic or organic, which can be used at levels from about 0% to about 50% by weight of the composition, preferably from 3% to about 35% by weight.

As used herein, the term electrolyte means any water-soluble salt.

Preferably the composition comprises at least 1.0% by weight, more preferably at least 5.0% by weight, most preferably at least 10.0% by weight of electrolyte. The electrolyte may also be a detergency builder, such as the inorganic builder sodium tripolyphosphate, or it may be a non-functional electrolyte such as sodium sulfate or chloride. Preferably the inorganic builder comprises all or part of the electrolyte.

The composition may comprise at least about 1%, preferably at least about 3%, preferably 3% to as much as about 50% by weight electrolyte.

The compositions of the invention are preferably capable of suspending particulate solids, although particularly preferred are those systems where such solids are actually in suspension. The solids may be undissolved electrolyte, the same as or different from the electrolyte in solution, the latter being saturated electrolyte. Additionally, or alternatively, they may be materials which are substantially insoluble in water alone. Examples of such substantially insoluble materials are aluminosilicate builders and particles of calcite abrasive.

Examples of suitable inorganic alkaline detergency builders which may be used are water-soluble alkali metal phosphates, polyphosphates, borates, silicates and also carbonates. Specific examples of such salts are sodium and potassium triphosphates, pyrophosphates, orthophosphates, hexametaphosphates, tetraborates, silicates, and carbonates.

Examples of suitable organic alkaline detergency builder salts are: (1) water-soluble amino polycarboxylates, e.g., sodium and potassium ethylenediaminetetraacetates, nitrilotriacetates and N-(2 hydroxyethyl)-nitrilodiacetates; (2) water-soluble salts of phytic acid, e.g., sodium and potassium phytates (see U.S. Pat. No. 2,379,942); (3) water-soluble polyphosphonates, including specifically, sodium, potassium and lithium salts of ethane-1-hydroxy-1,1-diphosphonic acid; sodium, potassium and lithium salts of methylene diphosphonic acid; sodium, potassium and lithium salts of ethylene diphosphonic acid; and sodium, potassium and lithium salts of ethane-1,1,2-triphosphonic acid. Other examples include the alkali metal salts of ethane-2-carboxy-1,1-diphosphonic acid hydroxymethanediphosphonic acid, carboxyldiphosphonic acid, ethane-1-hydroxy-1,1,2-triphosphonic acid, ethane-2-hydroxy-1,1,2-triphosphonic acid, propane-1,1,3,3-tetraphosphonic acid, propane-1,1,2,3-tetraphosphonic acid, and propane-1,2,2,3-tetra-phosphonic acid; (4) water-soluble salts of polycarboxylates polymers and copolymers as described in U.S. Pat. No. 3,308,067.

In addition, polycarboxylate builders can be used satisfactorily, including water-soluble salts of mellitic acid, citric acid, and carboxymethyloxysuccinic acid, salts of polymers of itaconic acid and maleic acid, tartrate monosuccinate, tartrate disuccinate and mixtures thereof (TMS/TPS).

Certain zeolites or aluminosilicates can be used. One such aluminosilicate which is useful in the compositions of the invention is an amorphous water-insoluble hydrated compound of the formula $Na_x[(AlO_2)_y.SiO_2)$, wherein x is a number from 1.0 to 1.2 and y is 1, said amorphous material being further characterized by a Mg++ exchange capacity of from about 50 mg eq. $CaCO_3$/g. and a particle diameter of from about 0.01 mm to about 5 mm. This ion exchange builder is more fully described in British Pat. No. 1,470,250.

A second water-insoluble synthetic aluminosilicate ion exchange material useful herein is crystalline in nature and has the formula $Na_z[(AlO_2)_y(SiO_2)]_xH_2O$, wherein z and y are integers of at least 6; the molar ratio of z to y is in the range from 1.0 to about 0.5, and x is an integer from about 15 to about 264; said aluminosilicate ion exchange material having a particle size diameter from about 0.1 mm to about 100 mm; a calcium ion exchange capacity on an anhydrous basis of at test about 200 milligrams equivalent of $CaCO_3$ hardness per gram; and a calcium exchange rate on an anhydrous basis of at least about 2 grains/gallon/minute/gram. These synthetic aluminosilicates are more fully described in British Patent No. 1,429,143.

Enzymes

Enzymes which may be used in this invention are described in greater detail below.

If a lipase is used, the lipolytic enzyme may be either a fungal lipase producible by *Humicola lanuginosa* and *Thermomyces lanuginosus*, or a bacterial lipase which show a positive immunological cross-reaction with the antibody of the lipase produced by the microorganism *Chromobacter viscosum* var. *lipolyticum* NRRL B-3673. This microorganism has been described in Dutch patent specification 154, 269 of Toyo Jozo Kabushiki Kaisha and has been deposited with the Fermentation Research Institute, Agency of Industrial Science and Technology, Ministry of International Trade and Industry, Tokyo, Japan, and added to the permanent collection under nr. KO Hatsu Ken Kin Ki 137 and is available to the public at the United States Department of Agriculture, Agricultural Research Service, Northern Utilization and Development Division at Peoria, Ill., USA, under the nr. NRRL B-3673. The lipase produced by this microorganism is commercially available from Toyo Jozo Co., Tagata, Japan, hereafter referred to as "TJ lipase". These bacterial lipases should show a positive immunological cross-reaction with the TJ lipase antibody, using the standard and well-known immune diffusion procedure according to Ouchterlony (Acta. Med. Scan., 133. pages 76–79 (1930).

The preparation of the antiserum is carried out as follows:

Equal volumes of 0.1 mg/ml antigen and of Freund's adjuvant (complete or incomplete) are mixed until an emulsion is obtained. Two female rabbits are injected 45 with 2 ml samples of the emulsion according to the following scheme:

day 0: antigen in complete Freund's adjuvant day 4: antigen in complete Freund's adjuvant day 32: antigen in incomplete Freund's adjuvant day 64: booster of antigen in incomplete Freund's adjuvant The serum containing the required antibody is prepared by centrifugation of clotted blood, taken on day 67.

The titre of the anti-TJ-lipase antiserum is determined by the inspection of precipitation of serial dilutions of antigen and antiserum according to the Ouchteriony procedure. A dilution of antiserum was the dilution that still gave a visible precipitation with an antigen concentration of 0.1 mg/ml.

All bacterial lipases showing a positive immunological cross reaction with the TJ-lipase antibody as hereabove described are lipases suitable in this embodiment of the invention. Typical examples thereof are the lipase ex *Pseudomonas fluorescens* IAM 1057 (available from Amano Pharmaceutical Co., Nagoya, Japan, under the trade-name Amano-P lipase), the lipase ex *Pseudomonas fragi* FERM P 1339 (available under the trade-name Amano B), the lipase ex *Pseudomonas nitroreducens* var. lipolyticum FERM P1338, the lipase ex Pseudomonas sp. (available under the trade-name Amano CES), the lipase ex *Pseudomonas cepacia*, lipases ex *Chromobacter viscosum*, e.g. *Chromobacter viscosum* var. *lipolyticum* NRRL B-3673, commercially available from Toyo Jozo Co., Tagata, Japan; and further *Chromobacter viscosum* lipases from U.S. Biochemical Corp. USA and Diosynth Co., The Netherlands, and lipases ex *Pseudomonas gladioli.*

An example of a fungal lipase as defined above is the lipase ex *Humicola lanuginosa* available from Amano under the tradename Amano CE; the lipase ex *Humicola lanuginosa* as described in the aforesaid European Patent Application 0,258,068 (NOVO), as well as the lipase obtained by cloning the gene from *Humicola lanuginosa* and expressing this gene in *Aspergillus oryzae*, commercially available from NOVO industri A/S under the tradename "Lipolase". This lipolase is a preferred lipase for use in the present invention.

While various specific lipase enzymes have been described above, it is to be understood that any lipase which can confer the desired lipolytic activity to the composition may be used and the invention is not intended to be limited in any way by specific choice of lipase enzyme.

The lipases of this embodiment of the invention are included in the liquid detergent composition in such an amount that the final composition has a lipolytic enzyme activity of from 100 to 0.005 LU/ml in the wash cycle, preferably 25 to 0.05 LU/ml when the formulation is. dosed at a level of about 0.1–10, more preferably 0.5–7, most preferably 1–2 g/liter.

A Lipase Unit (LU) is that amount of lipase which produces 1/mmol of titratable fatty acid per minute in a pH state under the following conditions: temperature 30° C.; pH=9.0; substrate is an emulsion of 3.3 wt. % of olive oil and 3.3% gum arabic, in the presence of 13 mmol/l $Ca^{2+}$ and 20 mmol/l NaCl in 5 mmol/l Trisbuffer.

Naturally, mixtures of the above lipases can be used. The lipases can be used in their non-purified form or in a purified form, e.g. purified with the aid of well-known absorption methods, such as phenyl sepharose absorption techniques.

If a protease is used, the proteolytic enzyme can be of vegetable, animal or microorganism origin. Preferably, it is of the latter origin, which includes yeasts, fungi, molds and bacteria. Particularly preferred are bacterial subtilisin type proteases, obtained from, e.g., particular strains of *B. subtilis* and *B licheniformis*. Examples of suitable commercially available proteases are Alcalase, Savinase, Esperase, all of NOVO Industri A/S; Maxatase and Maxacal of Gist-Brocades; Kazusase of Showa Denko; BPN and BPN' proteases and so on. The amount of proteolytic enzyme, included in the composition, ranges from 0.05–50,000 GU/mg. preferably 0.1 to 50 GU/mg, based on the final composition. Naturally, mixtures of different proteolytic enzymes may be used.

While various specific enzymes have been described above, it is to be understood that any protease which can confer the desired proteolytic activity to the composition may be used and this embodiment of the invention is not limited in any way be specific choice of proteolytic enzyme.

In addition to lipases or proteases, it is to be understood that other enzymes such as cellulases, oxidases, amylases, peroxidases and the like which are well known in the art may also be used with the composition of the invention. The enzymes may be used together with cofactors required to promote enzyme activity, i.e., they may be used in enzyme systems, if required. It should also be understood that enzymes having mutations at various positions (e.g., enzymes engineered for performance and/or stability enhancement) are also contemplated by the invention. One example of an engineered commercially available enzyme is Durazym from Novo.

UV Absorbers

In accordance with the invention it may be possible to exclude or essentially exclude UV absorbing materials from the detergent compositions, and/or packaging materials (other than the label) although in appropriate cases they may be included.

Among families of UV absorbers which may be used where appropriate are benzophenones, salicyclates, benzotriazoles, hindered amines and alkoxy (e.g., methoxy) cinnamates. Recitation of these classes is not meant to be a limitation on other classes of UV absorbers which may be used.

Among the benzotriazole UV absorbers which may be used are 2-(2-hydroxy-5-methylphenyl) benzotriazole which is available as Tinuvin P from Ciba-Geigy Corp. of Tarrytown, N.Y.

Water soluble UV absorbers particularly useful for this application include, but are not limited to: phenyl benzimidazole sulfonic acid (sold as Neo Heliopan, Type Hydro by Haarmann and Reimer Corp.), 2-hydroxy-4-methoxybenzophenone-5-sulfonic acid (sold as Syntase 230 by Rhone-Poulenc and Uvinul MS-40 by BASF Corp.), sodium 2,2'-dihydroxy-4,4'-dimethoxy-5-sulfobenzophenone (sold as Uvinul DS-49 by BASF Corp.), and PEG-25 paraaminobenzoic acid (sold as Uvinul P-25 by Basf Corp.).

Other UV absorbers which may be used are defined in McCutcheon's Volume 2, Functional Materials, North American Edition, published by the Manufacturing Confectioner Publishing Company (1997), which is hereby incorporated by reference into the subject application.

UV absorber if used, may be present in each of the label and optionally the package and the formulation at from about 0.001% to about 3 wt. %, preferably, if present, between 0.001 and 0.05 wt. %, although in certain cases preferred ranges may be from 0.05% to 1 wt. %.

Alkalinity buffers which may be added to the compositions of the invention include monoethanolamine, triethanolamine, borax, sodium silicate and the like.

Hydrotropes which may be added to the invention include ethanol, sodium xylene sulfonate, sodium cumene sulfonate and the like.

Other materials such as clays, particularly of the water-insoluble types, may be useful adjuncts in compositions of this invention. Particularly useful is bentonite. This material is primarily montmorillonite which is a hydrated aluminum silicate in which about ⅙ th of the aluminum atoms may be replaced by magnesium atoms and with which varying amounts of hydrogen, sodium, potassium, calcium, etc. may be loosely combined. The bentonite in its more purified form (i.e. free from any grit, sand, etc.) suitable for detergents contains at least 30% montmorillonite and thus its cation exchange capacity is at least about 50 to 75 meg per 100 g of bentonite. Particularly preferred bentonites are the Wyoming or Western U.S. bentonites which have been sold as Thixo-jels 1, 2, 3 and 4 by Georgia Kaolin Co. These bentonites are known to soften textiles as described in British Patent No. 401,413 to Marriott and British Patent No. 461,221 to Marriott and Guam.

In addition, various other detergent additives or adjuvants may be present in the detergent product to give it additional desired properties, either of functional or aesthetic nature.

Improvements in the physical stability and anti-settling properties of the composition may be achieved by the addition of a small effective amount of an aluminum salt of a higher fatty acid, e.g., aluminum stearate, to the composition. The aluminum stearate stabilizing agent can be added in an amount of 0 to 3%, preferably 0.1 to 2.0% and more preferably 0.5 to 1.5%.

There also may be included in the formulation, minor amounts of soil suspending or anti-redeposition agents, e.g. polyvinyl alcohol, fatty amides, sodium carboxymethyl cellulose, hydroxy-propyl methyl cellulose, A preferred anti-redeposition agent is sodium carboxylmethyl cellulose having a 2:1 ratio of CM/MC which is sold under the tradename Relatin DM 4050.

Another minor ingredient is soil releasing agent(s), e.g. deflocculating polymers. In general, a deflocculating polymer comprises a hydrophilic backbone and one or more hydrophobic side chains.

The deflocculating polymer of the invention is described in greater detail in U.S. Pat. No. 5,147,576 to Montague et al. hereby incorporated by reference into the subject application, The deflocculating polymer generally will comprise, when used, from about 0.1 to about 5% of the composition, preferably 0.1 to about 2% and most preferably, about 0.5 to about 1.5%.

Optical brighteners for cotton, polyamide and polyester fabrics can be used. Suitable optical brighteners include Tinopal, stilbene, triazole and benzidine sulfone compositions, especially sulfonated substituted triazinyl stilbene, sulfonated naphthotriazole stilbene, benzidene sulfone, etc., most preferred are stilbene and triazole combinations. A preferred brightener is Stilbene Brightener N4 which is a dimorpholine dianilino stilbene sulfonate.

Anti-foam agents, e.g. silicone compounds, such as Silicane L 7604, can also be added in small effective amounts.

Bactericides, e.g. tetrachlorosalicylanilide and hexachlorophene, fungicides, dyes, pigments (water dispersible), preservatives, e.g. formalin, anti-yellowing agents, such as sodium carboxymethyl cellulose, pH modifiers and pH buffers, color safe bleaches, perfume and dyes and bluing agents such as Iragon Blue L2D, Detergent Blue 472/372 and ultramarine blue can be used.

Also, soil release polymers and cationic softening agents may be used.

The list of optional ingredients above is not intended to be exhaustive and other optional ingredients which may not be listed, but are well known in the art, may also be included in the composition.

Optionally, the inventive compositions may contain all or some the following ingredients: zwitterionic surfactants (e.g. Mirataine BET C-30 from Rhone-Poulenc Co.), cationic surfactants (e.g. Schercamox DML from Scher Chemicals, Inc.), anti-redeposition polymers, antidye transfer polymers, soil release polymers, protease enzymes, lipase enzymes, amylase enzymes, cellulase enzymes, peroxidase enzymes, enzyme stabilizers, perfume, opacifiers, and suspended particles of size range 300–5000 microns.

The compositions of the invention have a at least 50% transmittance of light using a 1 centimeter cuvette, at a wavelength of 410–800 nanometers, preferably 570–690 wherein the composition is substantially free oF dyes.

Alternatively, transparency of the composition may be measured as having an absorbency in the visible light wavelength (about 410 to 800 nm) of less than 0.3 which is in turn equivalent to at least 50% transmittance using cuvette and wavelength noted above. For purposes of the invention, as long as one wavelength in the visible light range has greater than 50% transmittance, it is considered to be transparent/translucent.

Enzyme deactivation as a result of UV-damage may occur at very low transmission of UV-B radiation.

All percentages, unless indicated otherwise, are intended to be percentages by weight. By "essentially free" herein is meant that less than 0.001 wt. % of the ingredient is present.

The following examples are intended to further illustrate the invention and are not intended to limit the invention in any way:

METHODOLOGY

Measurement of Absorbency and Transmittance

Instrument: Milton Roy Spectronic 601

Procedure:

1. Both the spectrophotometer and the power box are turned on and allowed to warm up for 30 minutes.
2. Set the wavelength.
   - type in the desired wavelength on the keypad (i.e., 590, 640, etc.)
   - press the [second function] key
   - press the "go to λ" [yes] key
   - machine is then ready to read at the chosen wavelength.

3. Zero the instrument.
   press the [second function] key
   press the "zero A" [% T/A/C]
   instrument should then read "XXX NM 0.000 A T"
4. Open the cover, place sample vertically and in front of the sensor.
5. Close the lid and record reading (ex. 640 NM 0.123 A T)

*Note: all readings are taken in "A" mode (absorbency mode)

*Note: zero instrument with every new wavelength change and/or new sample.

Absorbency Values for Two Typical Plastic Bottles

| Wavelength Nm | Polyethylene (HDPE); 0.960 mm thickness | Polypropylene (PP); 0.423 mm thickness |
|---|---|---|
| 254 (non-visible) | 1.612 | 1.886 |
| 310 (non-visible) | 1.201 | 0.919 |
| 360 (non-visible) | 0.980 | 0.441 |
| 590 (visible) | 0.525 | 0.190 |
| 640 (visible) | 0.477 | 0.169 |

It should be understood of course that the specific forms of the invention herein illustrated and described are intended to be representative only as certain changes may be made therein without departing from the clear teachings of the disclosure. Accordingly, reference should be made to the following appended claims in determining the full scope of the invention.

What is claimed is:

1. A package having one or more polymeric labels wherein at least one said label includes indicia and UV absorbers and is transparent or translucent, and wherein said package is a plastic package and is transparent or translucent in combination with consumer products which include colorant dyes wherein said consumer products are selected from the group consisting of light duty liquid detergents, heavy duty liquid detergents, automatic dishwashing gels, personal washing compositions and fabric softeners.

2. The package according to claim 1 where said package is a bottle.

3. The package according to claim 1 wherein said label includes 0.001 to 3 wt. % UV absorber.

4. The package according to claim 1 wherein said product is transparent or translucent.

5. The package according to claim 1 wherein said label covers 50% to 95% of all transparent or translucent surface area of said package.

6. The package according to claim 1 wherein said label covers from 80% to 95% of all transparent or translucent surface area of said package.

7. The package according to claim 1 wherein said label further includes fluorescent dyes.

8. The package according to claim 1 wherein said package is a multilayer bottle.

9. The package according to claim 1 wherein said package has a front and a back on opposite sides of said package and one said label is on each of said front and back.

10. The package according to claim 1 wherein said label wraps around the package extending continuously around the periphery of the package.

11. A package having one or more polymeric labels wherein at least one said label includes indicia and UV absorbers and is transparent or translucent, and wherein said package is a plastic package and is transparent or translucent, in combination with a transparent or translucent aqueous heavy duty liquid detergent composition comprising:

(a) 10 to 85% by wt. of a surfactant selected from the group consisting of anionic, nonionic, cationic, amphoteric, zwitterionic surfactants and mixtures thereof;

(b) 0.001 to 1% by wt. of a colorant dye; and (c) 0.001 to 1% by weight fluorescent dye;

wherein the transparent composition has about 50% transmittance or greater of light using a 1 cm cuvette at wavelengths of 410–800 nanometers; and wherein the transparent or translucent package has light transmittance of greater than 25% at a wavelength of about 410–800 nm.

12. The package according to claim 11 wherein said heavy duty liquid detergent further includes 0.001 to 5% by weight of an enzyme selected from the group consisting of proteases, lipases, cellulases, oxidases, amylases and mixtures thereof.

* * * * *